US010947831B2

(12) United States Patent
Xiao et al.

(10) Patent No.: US 10,947,831 B2
(45) **Date of Patent: *Mar. 16, 2021**

(54) FLUID DRIVEN COMMINGLING SYSTEM FOR OIL AND GAS APPLICATIONS

(71) Applicant: Saudi Arabian Oil Company, Dhahran (SA)

(72) Inventors: Jinjiang Xiao, Dhahran (SA); Rafael Lastra, Dhahran (SA); Shoubo Wang, Broken Arrow, OK (US)

(73) Assignee: Saudi Arabian Oil Company

( * ) Notice: Subject to any disclaimer, the term of this patent is extended or adjusted under 35 U.S.C. 154(b) by 28 days.

This patent is subject to a terminal disclaimer.

(21) Appl. No.: 16/439,498

(22) Filed: Jun. 12, 2019

(65) Prior Publication Data

US 2019/0292894 A1 Sep. 26, 2019

Related U.S. Application Data

(63) Continuation-in-part of application No. 15/088,745, filed on Apr. 1, 2016, now Pat. No. 10,385,673.
(Continued)

(51) Int. Cl.
*E21B 43/38* (2006.01)
*E21B 43/12* (2006.01)
*E21B 41/00* (2006.01)

(52) U.S. Cl.
CPC ..... *E21B 43/38* (2013.01); *E21B 41/00* (2013.01); *E21B 43/128* (2013.01)

(58) Field of Classification Search
CPC .... E21B 43/121; E21B 43/122; E21B 43/128; E21B 43/38
See application file for complete search history.

(56) References Cited

U.S. PATENT DOCUMENTS 4,088,459 A * 5/1978 Tuzson ..... B01D 45/16 166/105.5
4,294,573 A * 10/1981 Erickson ..... E21B 43/124 415/121.2
(Continued)

FOREIGN PATENT DOCUMENTS

EP 1445420 A2 8/2004
WO WO-0226345 A1 * 4/2002 ..... E21B 43/121
(Continued)

OTHER PUBLICATIONS

Bhatia et al., "Artificial Lift: Focus on Hydraulic Submersible Pumps", The Way Ahead Tech 101, 2014, pp. 29-31, vol. 10, No. 3.
(Continued)

*Primary Examiner* — Jennifer H Gay
(74) *Attorney, Agent, or Firm* — Bracewell LLP; Constance R. Rhebergen

(57) ABSTRACT

A fluid management system positioned in a wellbore for recovering a multiphase stream from the wellbore. The system comprising a downhole separator configured to produce a carrier fluid having a carrier fluid pressure and a separated fluid having a separated fluid pressure, an artificial lift device configured to increase the carrier fluid pressure to produce the turbine feed stream having a turbine feed pressure, a turbine configured to convert fluid energy in the turbine feed stream to harvested energy, the conversion fluid energy from the turbine feed stream to harvested energy produces a turbine discharge stream having a turbine discharge pressure less than the turbine feed pressure, and a pressure boosting device configured to convert the harvested energy to pressurized fluid energy, the conversion of harvested energy to pressurized fluid energy produces a pressurized fluid stream having a pressurized fluid pressure greater than the separated fluid pressure.

11 Claims, 7 Drawing Sheets

Related U.S. Application Data

(60) Provisional application No. 62/141,434, filed on Apr. 1, 2015.

(56) References Cited

U.S. PATENT DOCUMENTS 4,712,984 A * 12/1987 Lepert ..... E21B 43/121 417/391
5,044,440 A 9/1991 Stinessen
5,605,193 A 2/1997 Bearden
5,730,871 A * 3/1998 Kennedy ..... B01D 17/0217 166/265
5,755,288 A 5/1998 Bearden et al.
5,794,697 A * 8/1998 Wolflick ..... E21B 43/385 166/169
6,026,901 A * 2/2000 Brady ..... E21B 43/385 166/265
6,113,357 A 9/2000 Dobbs
6,131,655 A * 10/2000 Shaw ..... E21B 43/12 166/105.5
6,138,758 A * 10/2000 Shaw ..... B04C 5/00 166/265
6,168,388 B1 * 1/2001 Hughes ..... E21B 43/124 417/245
6,189,614 B1 * 2/2001 Brady ..... E21B 43/40 166/266
6,283,204 B1 9/2001 Brady
6,336,503 B1 1/2002 Alhanati
6,357,530 B1 * 3/2002 Kennedy ..... E21B 43/124 166/105.6
6,497,287 B1 12/2002 Podio
6,547,003 B1 4/2003 Bangash
6,564,865 B1 5/2003 Brady
6,672,387 B2 * 1/2004 Brady ..... E21B 43/34 166/105.5
6,691,781 B2 2/2004 Grant et al.
6,860,921 B2 3/2005 Hopper
7,093,661 B2 * 8/2006 Olsen ..... E21B 37/00 166/357
7,104,321 B2 9/2006 Carruth
7,178,592 B2 2/2007 Chitty
7,461,692 B1 * 12/2008 Wang ..... B01D 19/0057 166/105.5
7,569,097 B2 8/2009 Campen
8,006,757 B2 8/2011 Hackworth
8,066,077 B2 * 11/2011 Lawson ..... F04D 25/0686 166/369
8,257,055 B2 9/2012 Beg
8,397,811 B2 * 3/2013 Reid ..... E21B 43/128 166/265
8,448,699 B2 * 5/2013 Camilleri ..... F04B 47/06 166/54.1
9,004,166 B2 4/2015 Raglin
9,915,134 B2 * 3/2018 Xiao ..... F04B 23/04
10,260,324 B2 * 4/2019 Muraikhi ..... E21B 43/124
10,385,673 B2 * 8/2019 Xiao ..... E21B 43/122
10,677,031 B2 * 6/2020 Xiao ..... E21B 43/128
2003/0145991 A1 * 8/2003 Olsen ..... E21B 43/129 166/265
2007/0158075 A1 7/2007 Beg
2009/0151928 A1 * 6/2009 Lawson ..... F04D 31/00 166/105.5
2010/0258306 A1 * 10/2010 Camilleri ..... E21B 43/38 166/265
2011/0162832 A1 * 7/2011 Reid ..... E21B 43/128 166/105.5
2013/0259721 A1 * 10/2013 Noui-Mehidi ..... F04B 47/06 417/410.1
2014/0377080 A1 * 12/2014 Xiao ..... E21B 43/38 417/53
2015/0233228 A1 * 8/2015 Roth ..... B01F 5/0615 166/372
2016/0201444 A1 * 7/2016 Hardee ..... E21B 43/38 166/265
2016/0290116 A1 * 10/2016 Xiao ..... E21B 43/121
2018/0038210 A1 * 2/2018 Xiao ..... E21B 43/38
2019/0292894 A1 * 9/2019 Xiao ..... E21B 43/38
2020/0248539 A1 * 8/2020 Xiao ..... F04B 23/04

FOREIGN PATENT DOCUMENTS

WO WO2012164382 A1 12/2012
WO WO2014027895 A1 2/2014
WO WO2014058778 A1 4/2014
WO WO-2015041655 A1 * 3/2015 ..... E21B 43/128
WO WO2015041655 A1 3/2015

OTHER PUBLICATIONS

Carvalho, P. M., A. L. Podio, and K. Sepehmoori. "Modeling a Jet Pump with an electrical Submersible Pump for Production of gassy petroleum wells." SPE Annual Technical Conference and Exhibition. Society of Petroleum Engineers, 1998. pp. 53-65.

Harden, W. G., and A. A. Downie. "Field Trial and Subsequent Large-Scale Deployment of a Novel Multiphase Hydraulic Submersible Pump in the Captain Field." Offshore Technology Conference. Offshore Technology Conference, 2001. (19 Pages).

International Search Report and Written Opinion for International Application No. PCT/US2016/025185; International filing date Mar. 31, 2016; dated Jun. 14, 2016. (11 Pages).

Mali, Gwyn Ardeshir, et al. "Hydraulic Submersible Pumps: 10 Years Experience on a Heavy-Oil Field in the North Sea." SPE Annual Technical Conference and Exhibition. Society of Petroleum Engineers, 2010. (13 Pages).

Manson, D. M. "Artificial Lift by Hydraulic Turbine-Driven Downhole Pumps: Its Development, Application, and Selection." International Meeting on Petroleum Engineering. Society of Petroleum Engineers, 1986. pp. 623-639.

* cited by examiner

FLUID DRIVEN COMMINGLING SYSTEM FOR OIL AND GAS APPLICATIONS

RELATED APPLICATION

This application is a continuation-in-part of and claims priority from U.S. Non-Provisional patent application Ser. No. 15/088,745 filed on Apr. 1, 2016, which claims priority from U.S. Provisional Application No. 62/141,434, filed on Apr. 1, 2015. For purposes of United States patent practice, this application incorporates the content of both the Provisional application and Non-Provisional application by reference in their entirety.

TECHNICAL FIELD

Described are a system and method for producing a multiphase fluid from a wellbore. More specifically, described are a system and method for extracting energy from a multiphase stream to drive a pressure boosting device.

BACKGROUND

There are a number of oil production operations where the use of downhole electric submersible pumps (ESPs) is necessary to ensure sufficient lift is created to produce a high volume of oil from the well. ESPs are multistage centrifugal pumps having anywhere from ten to hundreds of stages. Each stage of an electric submersible pump includes an impeller and a diffuser. The impeller transfers the shaft's mechanical energy into kinetic energy in the fluid. The diffuser then converts the fluid's kinetic energy into the fluid head or pressure necessary to lift the liquid from the wellbore. As with all fluids, ESPs are designed to run efficiently for a given fluid type, density, viscosity, and an expected amount of free gas.

Free gas, associated gas, or gas entrained in liquid is produced from subterranean formations in both oil production and water production. While ESPs are designed to handle small volumes of entrained gas, the efficiency of an ESP decreases rapidly in the presence of gas. The gas, or gas bubbles, builds up on the low-pressure side of the impeller, which in turn reduces the fluid head generated by the pump. Additionally, the volumetric efficiency of the ESP is reduced because the gas is filling the impeller vanes. At certain volumes of free gas, the pump can experience gas lock, during which the ESP will not generate any fluid head.

Methods to combat problems associated with gas in the use of ESPs can be categorized as gas handling and gas separation and avoidance.

In gas handling techniques, the type of impeller vane used in the stages of the ESP takes into account the expedited free gas volume. ESPs are categorized based on their impeller design as radial flow, mixed flow, and axial flow. In radial flow, the geometry of the impeller vane is more likely to trap gas and therefore it is limited to liquids having less than 10% entrained free gas. In mixed flow impeller stages, the fluid progresses along a more complex flow path, allowing mixed flow pumps to handle up to 25% (45% in some cases) free gas. In axial flow pumps, the flow direction is parallel to the shaft of the pump. The axial flow geometry reduces the opportunity to trap gases in the stages and, therefore, axial pumps can typically handle up to 75% free gas.

Gas separation and avoidance techniques involve separating the free gas from the liquid before the liquid enters the ESP. Separation of the gas from the liquid is achieved by gas separators installed before the pump suction, or by the use of gravity in combination with special completion design, such as shrouds. In most operations, the separated gas is then produced to the surface through the annulus between the tubing and the casing. In some operations, the gas is produced at the surface through separate tubing. In some operations the gas can be introduced back into the tubing that contains the liquids downstream of the pump discharge. In order to do this, the gas may need to be pressurized to achieve equalization of the pressure between the liquid discharged by the pump and the separated gas. A jet pump can be installed above the discharge of the ESP, the jet pump pulls in the gas. Jet pumps are complex and can have efficiency and reliability issues. In some cases however, the gas cannot be produced through the annulus due to systems used to separate the annulus from fluids in the wellbore.

Non-associated gas production wells can also see multiphase streams. Wet gas wells can have liquid entrained in the gas. As with liquid wells, artificial lift can be used to maintain gas production where the pressure in the formation is reduced. In such situations, downhole gas compressors (DGC) are used to generate the pressure necessary to lift the gas to the surface. DGCs experience problems similar to ESPs, when the liquid entrained in the gas is greater than 10%.

In addition to ESPs and DGCs, equipment at the surface can be used to generate pressure for producing the fluids from the wellbore. Multiphase Pumps (MPPs) and Wet Gas Compressors (WGCs) can be used on oil and gas fields respectively. MPP technologies are costly and complex, and are prone to reliability issues. Current WGC technology requires separation, compression, and pumping, where each compressor and pump requires a separate motor.

SUMMARY

Described are a system and method for producing a multiphase fluid from a wellbore. More specifically, described are a system and method for extracting energy from a multiphase stream to drive a pressure boosting device.

In a first aspect, a fluid management system positioned in a wellbore for recovering a multiphase fluid having a carrier fluid component and an entrained fluid component from the wellbore is provided. The fluid management system includes a downhole separator, the downhole separator configured to produce a carrier fluid and a separated fluid from the multiphase fluid, the carrier fluid having a concentration of the entrained fluid component, the carrier fluid having a carrier fluid pressure, the separated fluid having a separated fluid pressure, an artificial lift device, the artificial lift device fluidly connected to the downhole separator, the artificial lift device configured to increase the carrier fluid pressure to produce a turbine feed stream, the turbine feed stream having a turbine feed pressure, a turbine, the turbine fluidly connected to the artificial lift device, the turbine configured to convert fluid energy in the turbine feed stream to harvested energy, where the conversion in the turbine of fluid energy from the turbine feed stream to harvested energy produces a turbine discharge stream, the turbine discharge stream having a turbine discharge pressure, where the turbine discharge pressure is less than the turbine feed pressure, and a pressure boosting device, the pressure boosting device fluidly connected to the downhole separator and physically connected to the turbine, the pressure boosting device configured to convert the harvested energy to pressurized fluid energy, where conversion of harvested energy to pressurized fluid energy produces a pressurized fluid stream having a pressurized fluid pressure, where the pressurized fluid pressure is greater than the separated fluid pressure.

In certain aspects, the fluid management system further includes a mixer, the mixer fluidly connected to both the artificial lift device and the pressure boosting device, the mixer configured to commingle the turbine discharge stream and the pressurized fluid stream to produce a commingled production stream, the commingled production stream having a production pressure. In certain aspects, the artificial lift device is an electric submersible pump and the pressure boosting device is a compressor. In certain aspects, the artificial lift device is a downhole gas compressor and the pressure boosting device is a submersible pump. In certain aspects, a speed of the turbine is controlled by adjusting a flow rate of the turbine feed stream through the turbine. In certain aspects, the concentration of the entrained fluid component in the carrier fluid is less than 10% by volume. In certain aspects, the multiphase fluid is selected from the group consisting of oil entrained with gas, water entrained with gas, gas entrained with oil, gas entrained with water, and combinations thereof.

In a second aspect, a method for harvesting fluid energy from the turbine feed stream to power a pressure boosting device downhole in a wellbore is provided. The method includes the steps of separating a multiphase fluid, the multiphase fluid having a carrier fluid component and an entrained fluid component, in a downhole separator to generate a carrier fluid and a separated fluid, the carrier fluid having a concentration of the entrained fluid component, the carrier fluid having a carrier fluid pressure, the separated fluid having a separated fluid pressure, feeding the carrier fluid to an artificial lift device, the artificial lift device configured to increase the carrier fluid pressure to create the turbine feed stream, the turbine feed stream having a turbine feed pressure, feeding the turbine feed stream to a turbine, the turbine configured to convert fluid energy in the turbine feed stream to harvested energy, extracting the fluid energy in the turbine feed stream to produce harvested energy, where the extraction of the fluid energy from the turbine feed stream produces a turbine discharge stream, the turbine discharge stream having a turbine discharge pressure, where the turbine discharge pressure is less than the turbine feed pressure, and driving a pressure boosting device with the harvested energy, the pressure boosting device configured to convert the harvested energy to pressurized fluid energy, where the conversion of harvested energy to pressurized fluid energy produces a pressurized fluid stream having a pressurized fluid pressure, where the pressurized fluid pressure is greater than the separated fluid pressure.

In certain aspects, the method further includes the step of mixing the turbine discharge stream and the pressurized fluid stream in a mixer, the mixer configured to commingle the turbine discharge stream and the pressurized fluid stream to produce a commingled production stream, the commingled production stream having a production pressure. In certain aspects, the artificial lift device is an electric submersible pump and the pressure boosting device is a compressor. In certain aspects, the artificial lift device is a downhole gas compressor and the pressure boosting device is a submersible pump. In certain aspects, a speed of the turbine is controlled by adjusting a flow rate of the turbine feed stream through the turbine. In certain aspects, the concentration of the entrained fluid component in the carrier fluid is less than 10% by volume. In certain aspects, the multiphase fluid is selected from the group consisting of oil entrained with gas, water entrained with gas, gas entrained with oil, gas entrained with water, and combinations thereof.

In a third aspect, a method for employing fluid energy from an energized stream to drive a pressure boosting device is provided. The method including the steps of feeding the energized stream to a turbine, the energized stream having an energized pressure, the turbine configured to convert fluid energy in the energized stream to harvested energy, extracting the fluid energy in the energized stream to produce harvested energy, where the extraction of the fluid energy from the energized stream produces a turbine discharge stream, the turbine discharge stream having a turbine discharge pressure, where the turbine discharge pressure is less than the energized pressure, driving a pressure boosting device with the harvested energy, the pressure boosting device configured to convert the harvested energy to pressurized fluid energy, and increasing a pressure of a depressurized stream to generate a pressurized fluid stream, where the conversion of harvested energy to pressurized fluid energy in the turbine increases the pressure of the depressurized stream, the pressurized fluid stream having a pressurized fluid pressure, where the pressurized fluid pressure is greater than the pressure of the depressurized stream.

In certain aspects, the pressure boosting device is a compressor. In certain aspects, the pressure boosting device is a submersible pump. In certain aspects, a speed of the turbine is controlled by adjusting a flow rate of the energized stream through the turbine. In certain aspects, the energized stream is from an energized subterranean region. In certain aspects, the depressurized stream is from a depressurized subterranean region having a zonal pressure less than the energized subterranean region.

BRIEF DESCRIPTION OF THE DRAWINGS

These and other features, aspects, and advantages will become better understood with regard to the following descriptions, claims, and accompanying drawings. It is to be noted, however, that the drawings illustrate only several embodiments and are therefore not to be considered limiting of the inventive scope as it can admit to other equally effective embodiments.

DETAILED DESCRIPTION

While the invention will be described with several embodiments, it is understood that one of ordinary skill in the relevant art will appreciate that many examples, variations and alterations to the apparatus and methods described throughout are within the scope and spirit of the invention. Accordingly, the embodiments described throughout are set forth without any loss of generality, and without imposing limitations, on the claimed invention.

A method to produce multiphase fluids from a wellbore that allows for the separation of gases, while minimizing the complexity of the system is desired.

The fluid management system targets artificial lift and production boost either downhole or at the surface. In the example of an oil well producing some gas, a multiphase fluid is separated in a separator into a carrier fluid (a liquid dominated stream) and an entrained fluid (a gas dominated stream). A pump is used to energize the liquid dominated stream. The energized liquid dominated stream is then used to drive a turbine coupled to a compressor. The compressor is used to compress the gas dominated stream. The pump can be sized to provide sufficient power so that the pressure increase in both the liquid dominated stream and the gas dominated stream is sufficient to propel both streams to the surface.

Figure 1:
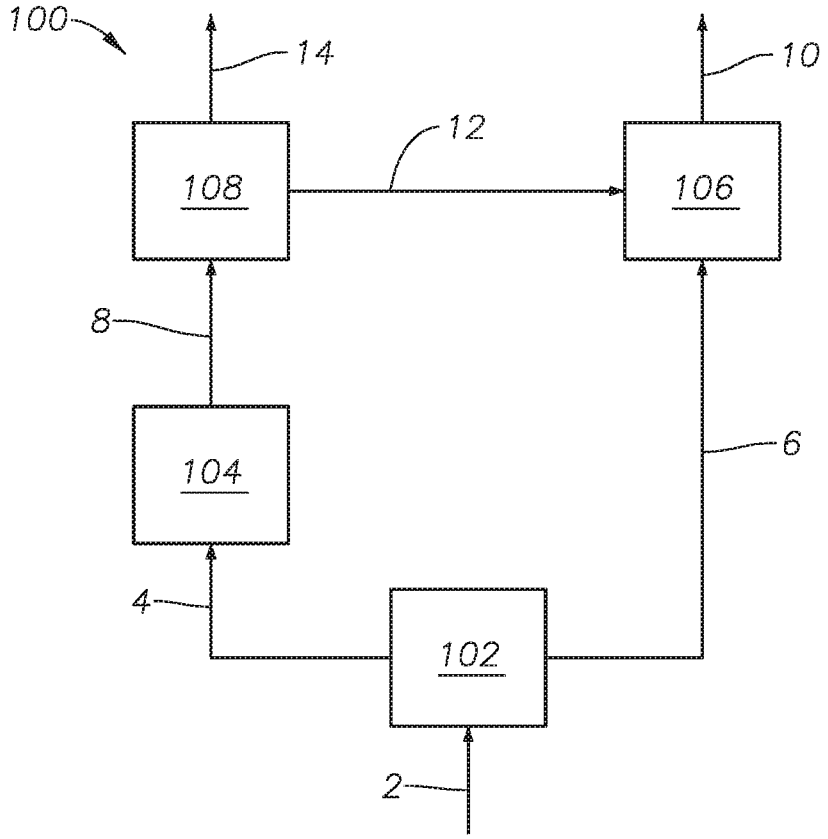
FIG. 1 is a flow diagram of an embodiment of the fluid management system.

FIG. 1 provides a flow diagram of an embodiment of the fluid management system. Fluid management system 100 is a system for recovering multiphase fluid 2. Fluid management system 100 is placed downhole in the wellbore to increase the pressure of multiphase fluid 2, to recover multiphase fluid 2 at the surface. Multiphase fluid 2 is any stream being produced from a subterranean formation containing a carrier fluid component with an entrained fluid component. Examples of carrier fluid components include oil, water, natural gas and combinations thereof. Examples of entrained fluid components include oil, water, natural gas, condensate, and combinations thereof. In at least one embodiment, multiphase fluid 2 is oil with natural gas entrained. In at least one embodiment, multiphase fluid 2 is water with natural gas entrained. In at least one embodiment, multiphase fluid 2 is a combination of oil and water with natural gas entrained. In at least one embodiment, multiphase fluid 2 is natural gas with oil entrained. In at least one embodiment, multiphase fluid 2 is natural gas with condensate entrained. The composition of multiphase fluid 2 depends on the type of subterranean formation. The amount of entrained fluid in multiphase fluid 2 can be between about 5% by volume and about 95% by volume.

Downhole separator 102 of fluid management system 100 receives multiphase fluid 2. Downhole separator 102 separates multiphase fluid 2 into carrier fluid 4 and separated fluid 6. Downhole separator 102 is any type of separator capable of separating a stream with multiple phases into two or more streams. Examples of separators suitable for use in the present invention include vapor-liquid separators, equilibrium separators, oil and gas separators, stage separators, knockout vessels, centrifugal separators, mist extractors, and scrubbers. Downhole separator 102 is designed to maintain structural integrity in the wellbore. In at least one embodiment, downhole separator 102 is a centrifugal separator.

Carrier fluid 4 contains the carrier fluid component from multiphase fluid 2. Examples of fluids that constitute carrier fluid 4 include oil, water, natural gas and combinations thereof. In at least one embodiment, carrier fluid 4 has a concentration of the entrained fluid component. The concentration of the entrained fluid component in carrier fluid 4 depends on the design and operating conditions of downhole separator 102 and the composition of multiphase fluid 2. The concentration of the entrained fluid component in carrier fluid 4 is between about 1% by volume and about 10% by volume, alternately between about 1% by volume and about 5% by volume, alternately between about 5% by volume and about 10% by volume, and alternately less than 10% by volume. Carrier fluid 4 has a carrier fluid pressure. In at least one embodiment, the pressure of carrier fluid 4 is the pressure of the fluids in the formation.

Separated fluid 6 contains the entrained fluid component from multiphase fluid 2. Separated fluid 6 is the result of the separation of the entrained fluid component from the carrier fluid component in downhole separator 102. Examples of fluids that constitute separated fluid 6 includes oil, water, natural gas, condensate, and combinations thereof. Separated fluid 6 contains a concentration of the carrier fluid component. The concentration of the carrier fluid component in separated fluid 6 depends on the design and operating conditions of downhole separator 102 and the composition of multiphase fluid 2. The concentration of carrier fluid component in separated fluid 6 is between about 1% by volume and about 10% by volume, alternately between about 1% by volume and about 5% by volume, alternately between about 5% by volume and about 10% by volume, and alternately less than 10% by volume. Separated fluid 6 has a separated fluid pressure. In at least one embodiment, the pressure of separated fluid 6 is the pressure of the fluids in the formation.

Carrier fluid 4 is fed to artificial lift device 104. Artificial lift device 104 is any device that increases the pressure of carrier fluid 4 and maintains structural and operational integrity under the conditions in the wellbore. The type of artificial lift device 104 selected depends on the phase of carrier fluid 4. Examples of phases include liquid and gas. In at least one embodiment, carrier fluid 4 is a liquid and artificial lift device 104 is an electric submersible pump. In at least one embodiment, carrier fluid 4 is a gas and artificial lift device 104 is a downhole gas compressor. Artificial lift device 104 increases the pressure of carrier fluid 4 to produce turbine feed stream 8. Turbine feed stream 8 has a turbine feed pressure. The turbine feed pressure is greater than the carrier fluid pressure. Artificial lift device 104 is driven by a motor. Examples of motors suitable for use in the present invention include a submersible electrical induction motor and a permanent magnet motor.

Separated fluid 6 is fed to pressure boosting device 106. Pressure boosting device 106 is any device that increases the pressure of separated fluid 6 and maintains structural and operational integrity under the conditions in the wellbore. The type of pressure boosting device 106 selected depends on the phase of separated fluid 6. Examples of phases include liquid and gas. In at least one embodiment, separated fluid 6 is a liquid and pressure boosting device 106 is a submersible pump. In at least one embodiment, separated fluid 6 is a gas and pressure boosting device 106 is a compressor. Pressure boosting device 106 increases the pressure of separated fluid 6 to produce pressurized fluid stream 10. Pressurized fluid stream 10 has a pressurized fluid pressure. The pressurized fluid pressure is greater than the separated fluid pressure.

Figure 8A:
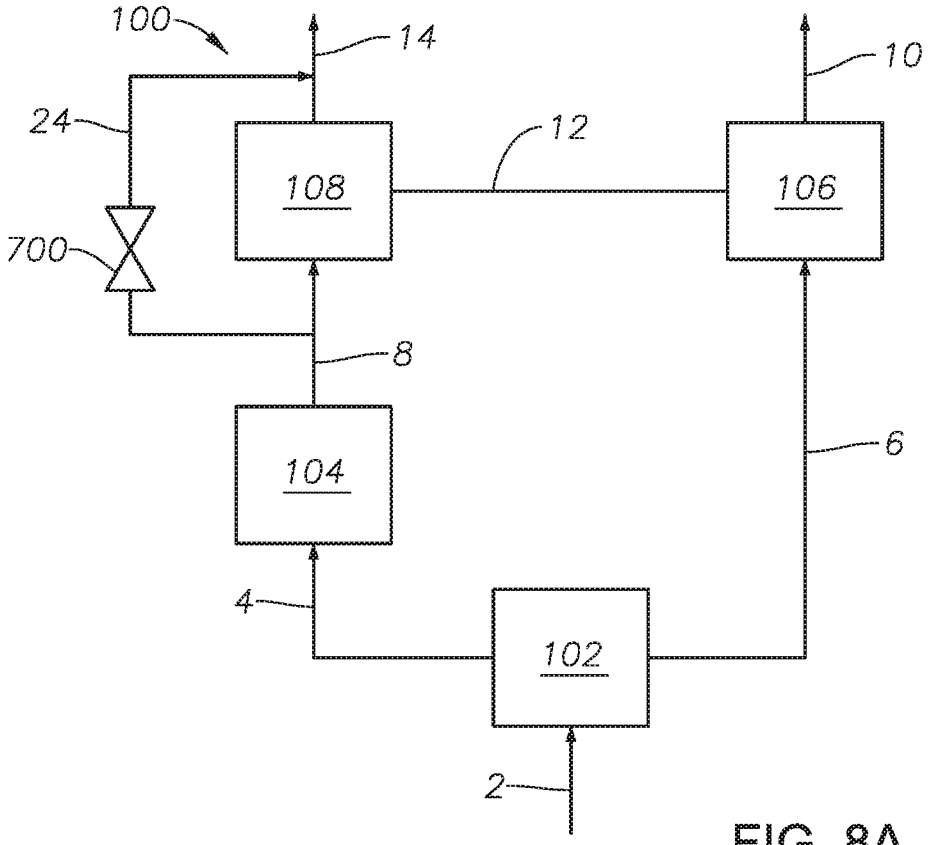
FIG. 8A provides a schematic of an embodiment of fluid management system 100.

Turbine feed stream 8 is fed to turbine 108. Turbine 108 is any mechanical device that extracts fluid energy (hydraulic power) from a flowing fluid and converts the fluid energy to mechanical energy (rotational mechanical power). Turbine 108 can be a turbine. Examples of turbines suitable for use include hydraulic turbines and gas turbines. The presence of a turbine in the system eliminates the need for more than one motor, which increases the reliability of the system. Turbine 108 converts the fluid energy in turbine feed stream 8 into harvested energy 12. The speed of turbine 108 is adjustable. In at least one embodiment, a bypass line provides control of the flow rate of turbine feed stream 8 entering turbine 108, which adjusts the speed (rotations per minute or RPMs) of turbine 108. As described with reference to FIG. 8A, bypass line 24 provides control of the flow rate of turbine feed stream 8 entering turbine 108, using valve 700. Valve 700, controlled at the surface, can divert a part of turbine feed stream 8 through bypass line 24 to turbine discharge stream 14, which can adjust the flow rate of turbine feed stream 8 to turbine 108. For example, opening valve 700 diverts an increased amount of flow through bypass line 24 which decreases the flow rate of turbine feed stream 8 to turbine 108. The flow rate of turbine feed stream 8 directs the speed (rotations per minute or RPMs) of turbine 108, where the velocity of turbine feed stream 8 translates to the RPMs of turbine 108. As a result, an increase in the flow rate of turbine feed stream 8 translates to an increase of RPMs in turbine 108 and thus and an increased speed of turbine 108. Changes in the flow rate (volume/unit of time) of a fluid in a fixed pipe results in changes to the velocity (distance/unit of time) of the fluid flowing in the pipe. Thus, changes in the flow rate of turbine feed stream 8 adjusts the velocity of turbine feed stream 8, which in turn changes the speed of rotation (RPMs) in turbine 108. In embodiments of the present invention, the fluid management system is in the absence of a gearbox due to the use of a bypass line to control the speed of turbine 108, the absence of a gearbox reduces the complexity of fluid management system 108 by eliminating an additional mechanical unit.

The conversion of fluid energy from turbine feed stream 8 in turbine 108 reduces the pressure of turbine feed stream 8 and produces turbine discharge stream 14. Turbine discharge stream 14 has a turbine discharge pressure. The turbine discharge pressure is less than the turbine feed pressure.

Turbine 108 is physically connected to pressure boosting device 106, such that harvested energy 12 drives pressure boosting device 106. One of skill in the art will appreciate that a turbine can be connected to a mechanical device through a linkage or a coupling (not shown). The coupling allows harvested energy 12 to be transferred to pressure boosting device 106, thus driving pressure boosting device 106. Pressure boosting device 106 operates without the use of an external power source. In at least one embodiment, the only electricity supplied to fluid management system 100 is supplied to artificial lift device 104. The linkage or coupling can be any link or coupling that transfers harvested energy 12 from turbine 108 to pressure boosting device 106. Examples of links or couplings include mechanical, hydraulic, and magnetic. Pressure boosting device 106 is in the absence of a motor. The driving force of the pressure boosting device is provided by the turbine.

Artificial lift device 104, pressure boosting device 106, and turbine 108 are designed such that the turbine discharge pressure of turbine discharge stream 14 lifts turbine discharge stream 14 to the surface to be recovered and the pressurized fluid pressure of pressurized fluid stream 10 lifts pressurized fluid stream 10 to the surface to be recovered. Artificial lift device 104 is designed to provide fluid energy to turbine feed stream 8 so turbine 108 can generate harvested energy 12 to drive pressure boosting device 106.

The combination of artificial lift device 104, pressure boosting device 106, and turbine 108 can be arranged in series, parallel, or concentrically as describes the physical arrangement of the units. One of skill in the art will appreciate that the positioning of each element of fluid management system 100 can be based on the size of each unit, the limited width and space in the wellbore, and the amount and components of multiphase fluid 2. One of skill in the art will appreciate that there is limited but known space in a wellbore and can design the positioning and size of each element accordingly. Additionally, the design can minimize the piping requirements and reduce complexity. Artificial lift device 104 and pressure boosting device 106 are not driven by the same motor. The fluid management system can be modular in design and packaging because the artificial lift device and the pressure boosting device are not driven by the same motor. The fluid management system is in the absence of a dedicated motor for the artificial lift device and a separate dedicated motor for the pressure boosting device.

Figure 3:
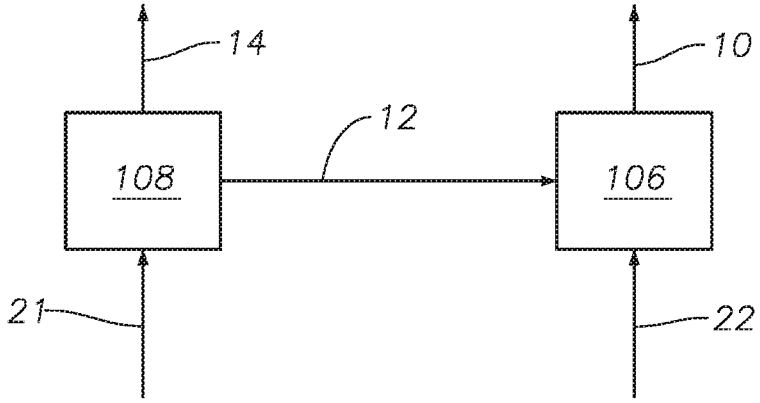
FIG. 3 is a flow diagram of an embodiment of the fluid management system.

When conditions downhole allow, the fluid management system is in the absence of any motor used to drive either the artificial lift device or the pressure boosting device. If a well is a strong well, there is enough hydraulic energy and the turbine can be driven by the carrier fluid, such as is shown in FIG. 3. As used here, "strong well" refers to a well that produces a fluid with enough hydraulic energy to be produced from the formation to the surface without the need for an energizing device and can drive a jet pump. As used here, a "weak well" refers to a well that produces a fluid that does not have enough hydraulic energy to be produced from the formation to the surface and thus requires the an energizing device, such as a jet pump.

Figure 2:
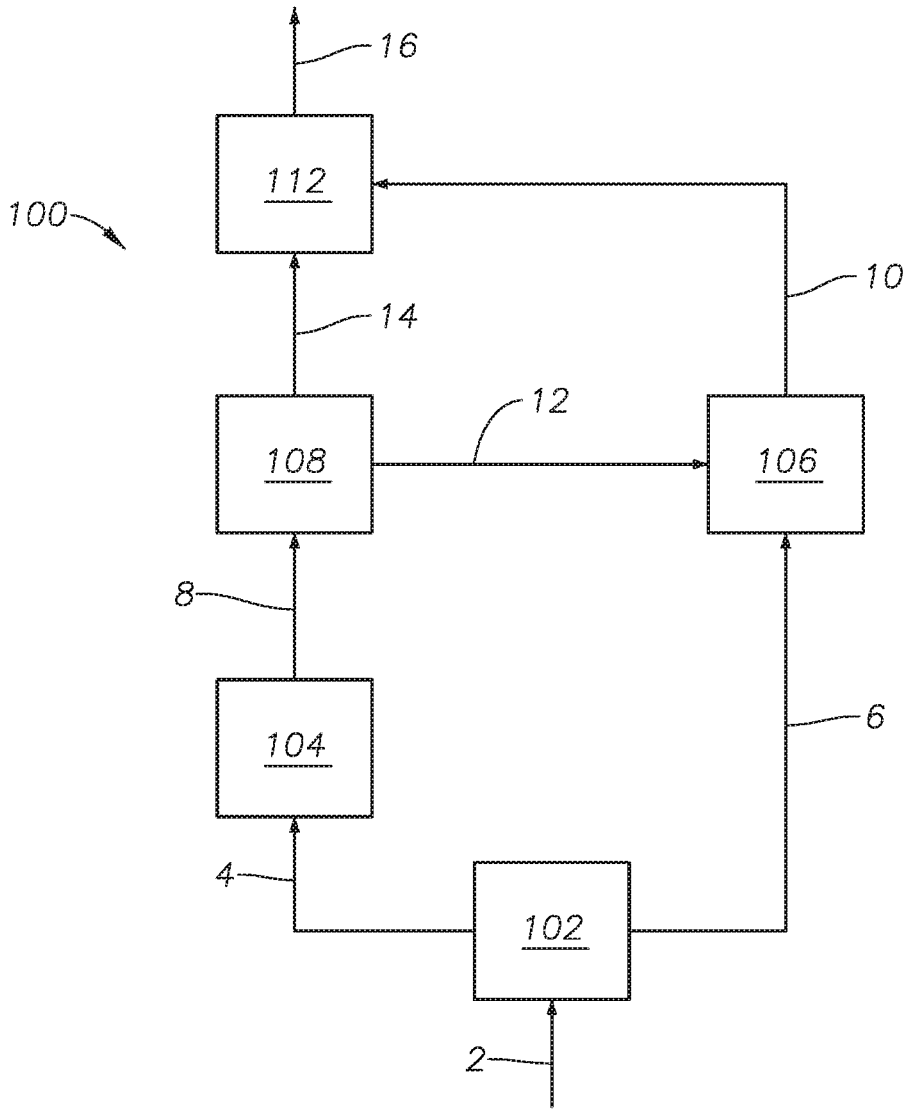
FIG. 2 is a flow diagram of an embodiment of the fluid management system.

Incorporating those elements described with reference to FIG. 1, FIG. 2 provides an embodiment. Turbine discharge stream 14 and pressurized fluid stream 10 are mixed in mixer 112 to produce commingled production stream 16. Commingled production stream 16 has a production pressure. Mixer 112 is any mixing device that commingles turbine discharge stream 14 and pressurized fluid stream 10 in a manner that produces commingled production stream 16 at the surface. In at least one embodiment, mixer 112 is a pipe joint connecting turbine discharge stream 14 and pressurized fluid stream 10. In at least one embodiment, commingled product stream 16 is not fully mixed. In at least one embodiment, artificial lift device 104, pressure boosting device 106, and turbine 108 are designed so that the production pressure of commingled production stream 16 lifts commingled production stream 16 to the surface to be recovered. In at least one embodiment, the pressurized fluid pressure and the turbine discharge pressure allow the pressurized fluid stream 10 and turbine discharge stream 14 to be commingled in mixer 112.

Figure 4:
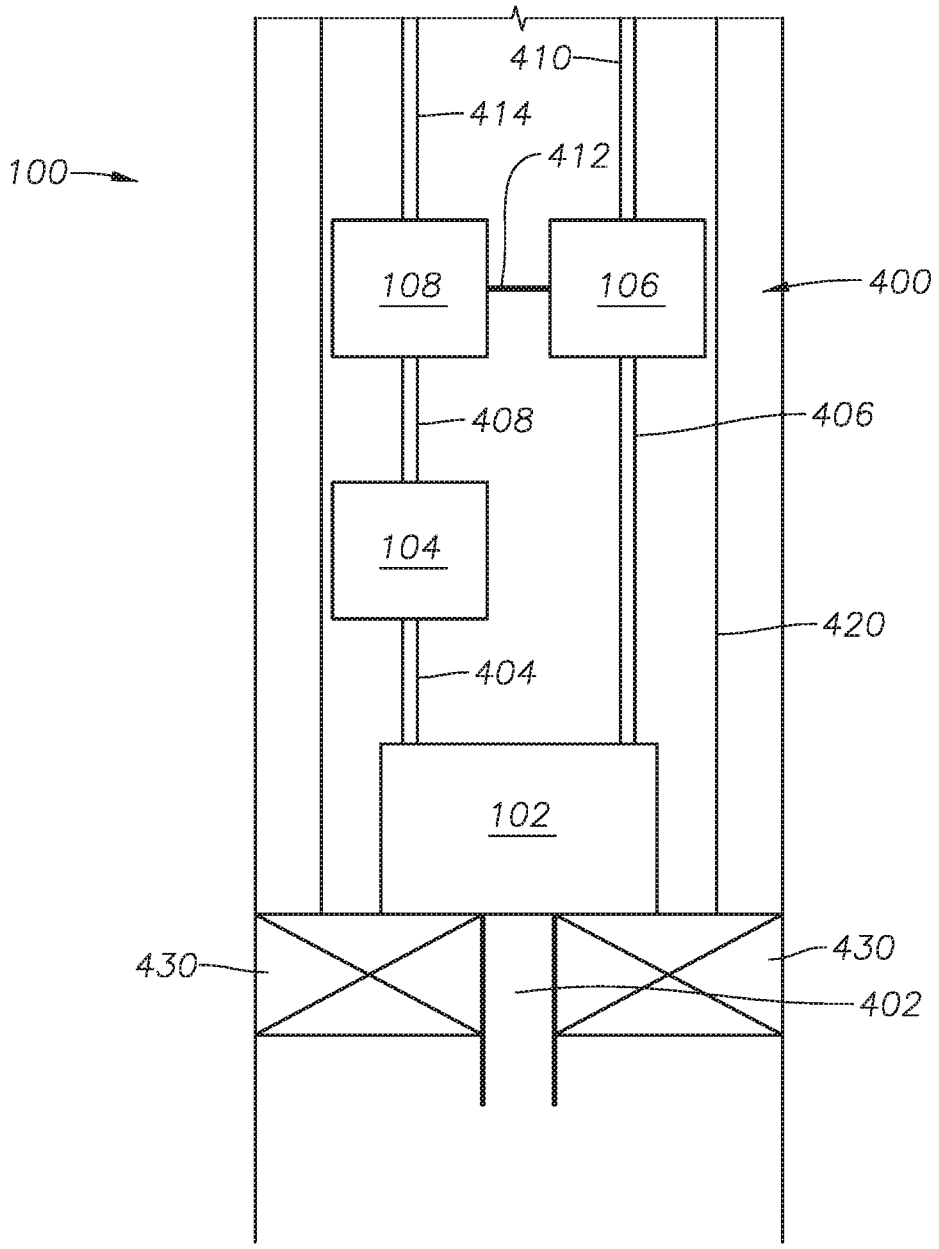
FIG. 4 provides a side plan view of an embodiment of fluid management system 100.

In at least one embodiment, as described with reference to FIG. 4, separator 102, artificial lift device 104, pressure boosting device 106, and turbine 108 are contained in the same production pipeline or production casing, production casing 420. Referring to FIG. 4, with reference to FIGS. 1-3, an embodiment of fluid management system 100 in wellbore 400 is shown. The multiphase fluid is received by downhole separator 102 through inlet tubing 402. Production casing 420 can be any type of pipeline or tubing sized to fit within the wellbore and to contain the units of fluid management system 100. Inlet tubing 402 can be any type of tubular fluid conveyance of a size and material suitable for use in wellbore 400. Examples of inlet tubing 402 can include tubing, piping, hose, or combinations of the same. Packers 430 can be used to channel the fluid into inlet tubing 402 and prevent fluid from entering production casing 420.

The carrier fluid is fed to artificial lift device 104 through carrier tubing 404. Carrier tubing 404 can be any type of tubular fluid conveyance of a material suitable for use in wellbore 400. Examples of carrier tubing 404 can include tubing, piping, hose, or combinations of the same. The size of carrier tubing 404 can be based on the volumetric flow rate of the carrier fluid. Carrier tubing 404 can include fittings and valves as required to connect carrier tubing 404 from separator 102 to artificial lift device 104.

The separated fluid is fed to pressure boosting device 106 through fluid tubing 406. Fluid tubing 406 can be any type of tubular fluid conveyance of a material suitable for use in wellbore 400. Examples of fluid tubing 406 can include tubing, piping, hose, or combinations of the same. The size of fluid tubing 406 can be based on the volumetric flow rate of the separated fluid. Fluid tubing 406 can include fittings and valves as required to connect fluid tubing 406 from separator 102 to pressure boosting device 106.

The turbine feed stream is fed to turbine 108 through turbine tubing 408. Turbine tubing 408 can be any type of tubular fluid conveyance of a material suitable for use in wellbore 400. Examples of turbine tubing 408 can include tubing, piping, hose, or combinations of the same. The size of turbine tubing 408 can be based on the volumetric flow rate of the turbine feed stream. Turbine tubing 408 can include fittings and valves as required to connect turbine tubing 408 from artificial lift device 104 and turbine 108.

Turbine 108 is physically connected to pressure boosting device 106 through coupling 412. Coupling 412 can be any kind of link or coupling that can transfer the harvested energy from turbine 108 to pressure boosting device 106. Examples of coupling 412 include mechanical, hydraulic, and magnetic.

The pressurized fluid stream is lifted to the surface through surface tubing 410. Surface tubing 410 can be any type of tubular fluid conveyance of a material suitable for use in wellbore 400. Examples of surface tubing 410 can include tubing, piping, hose, or combinations of the same. The size of surface tubing 410 can be based on the volumetric flow rate of the pressurized fluid stream. Surface tubing 410 can include fittings and valves as required to connect surface tubing 410 from pressure boosting device 106 to the surface.

The turbine discharge stream is lifted to the surface through discharge tubing 414. Discharge tubing 414 can be any type of tubular fluid conveyance of a material suitable for use in wellbore 400. Examples of discharge tubing 414 can include tubing, piping, hose, or combinations of the same. The size of discharge tubing 414 can be based on the volumetric flow rate of the turbine discharge stream. Discharge tubing 414 can include fittings and valves as required to connect discharge tubing 414 from turbine 108 to the surface.

Figure 5:
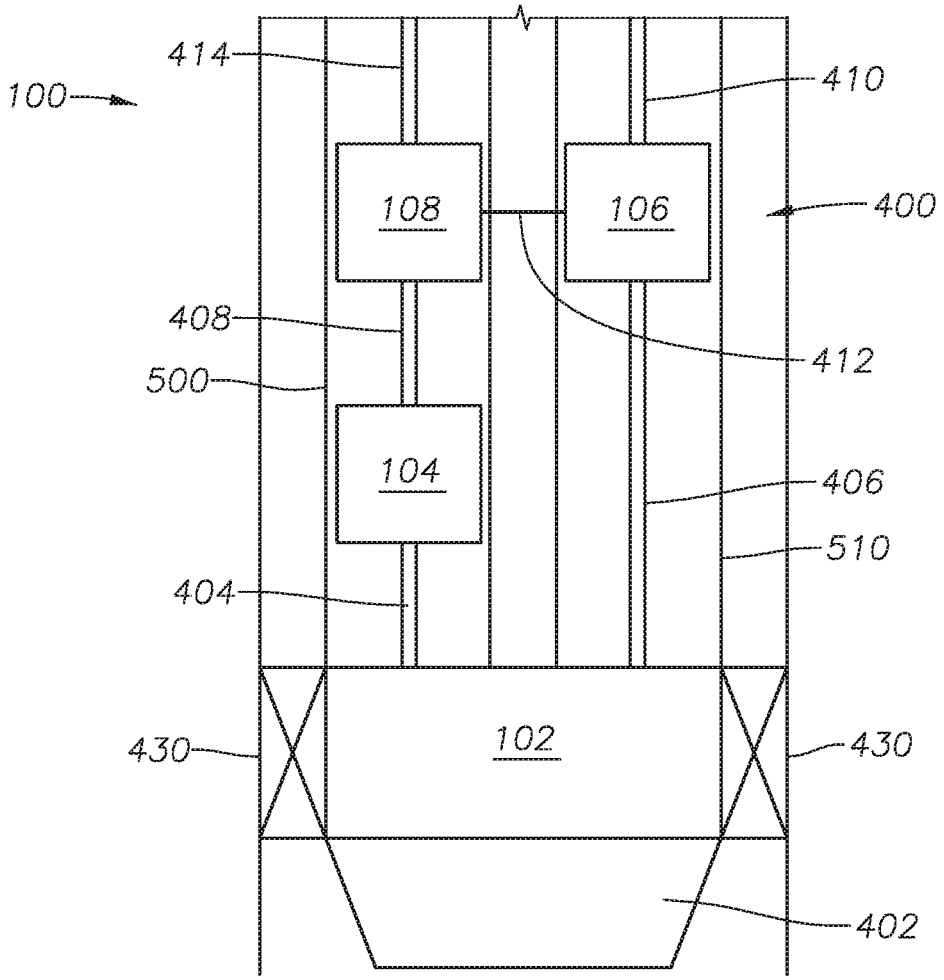
FIG. 5 provides a side plan view of an embodiment of fluid management system 100.

In an alternate embodiment, as described with reference to FIG. 5 artificial lift device 104 and turbine 108 are contained in a separate production line from pressure boosting device 106. Referring to FIG. 5, with reference to FIGS. 1 and 4, an embodiment of fluid management system 100 is provided. In this embodiment, artificial lift device 104 and turbine 108 are contained in production tube 500 and pressure boosting device 106 is contained in secondary tube 510, with each of the separate production tubings fluidly connected to downhole separator 102. Production tube 500 and secondary tube 510 are parallel to each other in wellbore 400. Production tube 500 can be any type of pipeline or tubing sized to fit within the wellbore and to contain the units of fluid management system 100. Secondary tube 510 can be any type of pipeline or tubing sized to fit within the wellbore and to contain the units of fluid management system 100. Coupling 412 can extend through the wall of production tube 500 and through the wall of secondary tube 510 to connect turbine 108 and pressure boosting device 106. Any fittings needed to secure the passage of coupling 412 through the walls of production tube 500 and secondary tube 510 can be used.

Figure 6:
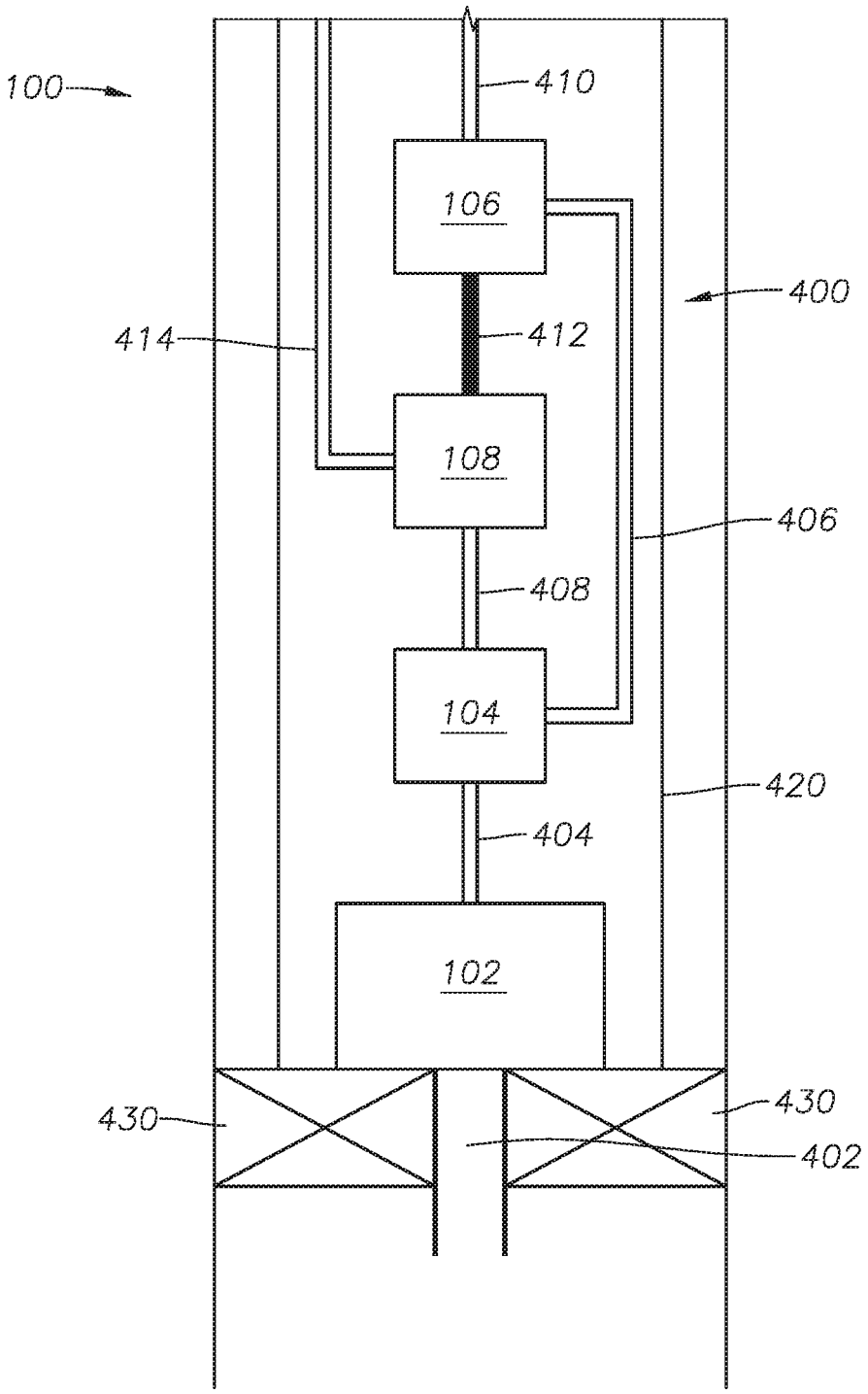
FIG. 6 provides a side plan view of an embodiment of fluid management system 100.

Referring to FIGS. 4 and 5, embodiments of fluid management system 100 arranged in parallel or partially in parallel are illustrated. Referring to FIG. 6, and with reference to FIG. 4, an embodiment of fluid management system 100 arranged in series is illustrated.

Figure 7A:
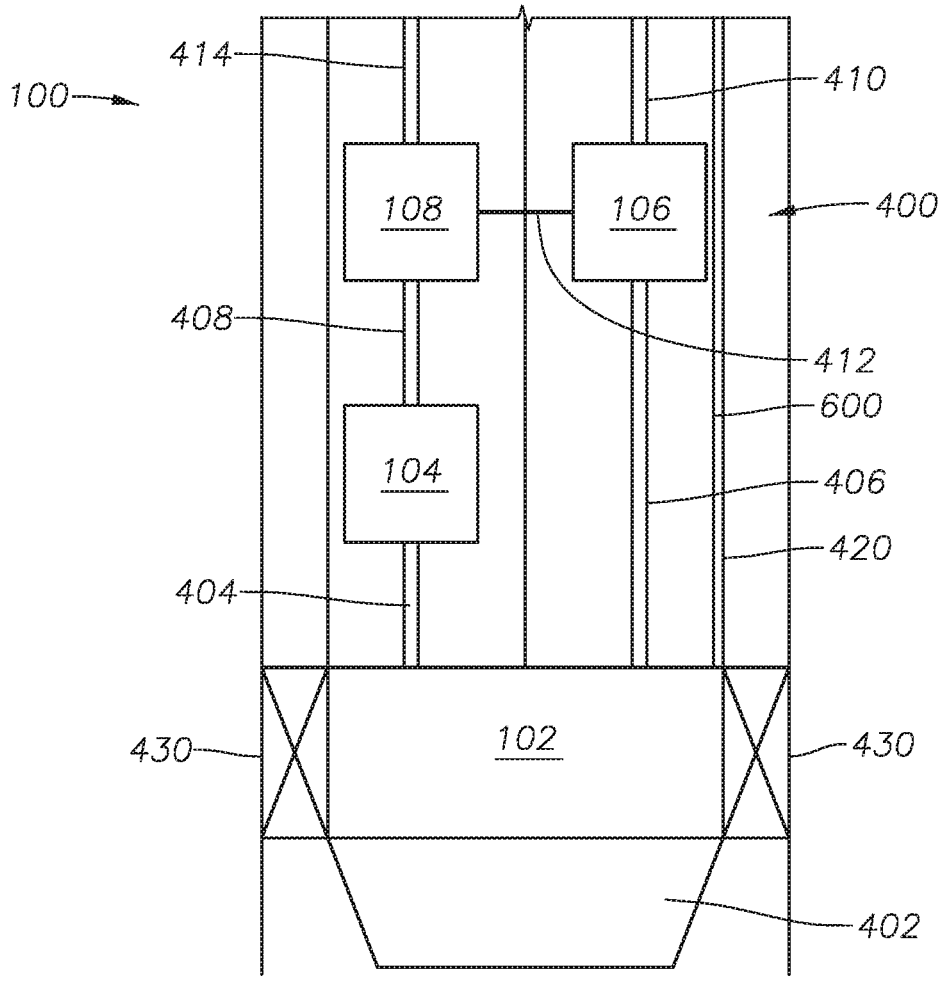
FIG. 7A provides a side plan view of an embodiment of fluid management system 100.
Figure 7B:
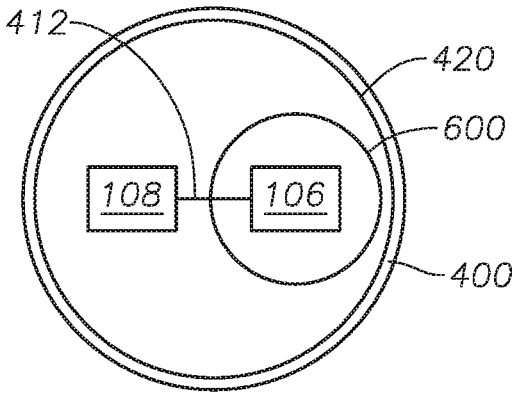
FIG. 7B provides a top plan view of an embodiment of fluid management system 100.
Figure 7C:
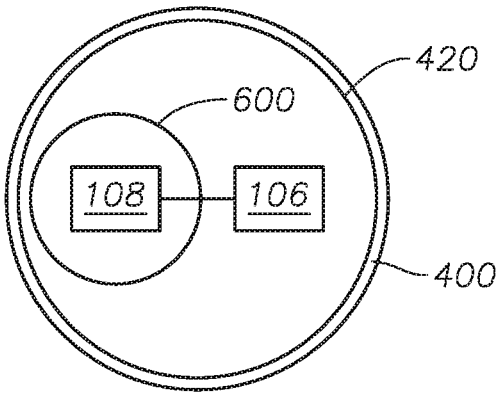
FIG. 7C provides a top plan view of an embodiment of fluid management system 100.

An embodiment of fluid management system 100 arranged in concentric production lines is shown in FIG. 7A and FIG. 7B and described with reference to FIG. 4. Artificial lift device 104 and turbine 108 are positioned in production casing 420. Inner tubing 600 is positioned in production casing 420. Inner tubing 600 can be any type of pipeline or tubing sized to fit within the wellbore, production casing 420, and to contain the units of fluid management system 100. Pressure boosting device 106 is positioned in inner tubing 600 with coupling 412 extending through the wall of inner tubing 600. FIG. 7C, described with reference to FIG. 7A and FIG. 7B, provides an alternate embodiment of fluid management system 100 arranged in concentric production lines. Pressure boosting device 106 is positioned in production casing 420. Artificial lift device 104 and turbine 108 are positioned in inner tubing 600.

In at least one embodiment, fluid management system 100 is in the absence of production casing and fluid management system 100 is positioned directly in the wellbore.

In at least one embodiment, fluid management system 100 includes sensors to measure system parameters. Examples of system parameters include flow rate, pressure, temperature, and density. The sensors enable process control schemes to control the process. Process control systems can be local involving preprogrammed control schemes within fluid management system 100, or can be remote involving wired or wireless communication with fluid management system 100. Process control schemes can be mechanical, electronic, or hydraulically driven.

Figure 8B:
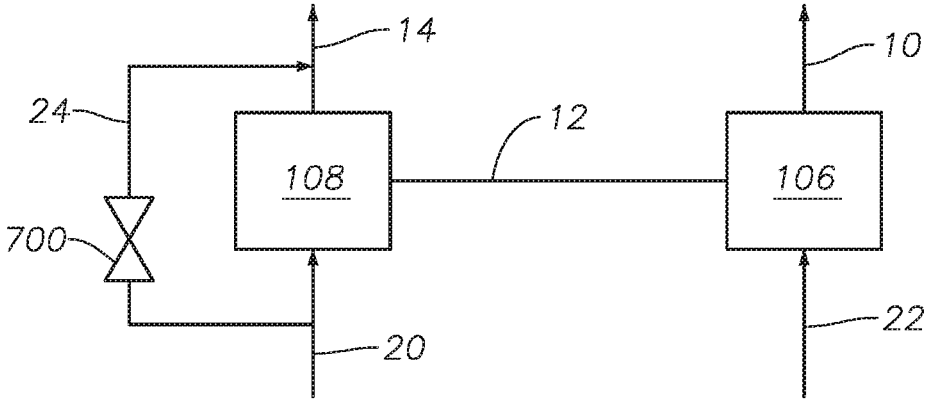
FIG. 8B provides a schematic of an embodiment of fluid management system 100.

Referring to FIG. 3, an embodiment of fluid management system 100 is provided. Energized stream 20 is received by turbine 108. Energized stream 20 is any stream having sufficient pressure to reach the surface from the wellbore. Energized stream 20 has an energized pressure. In at least one embodiment, energized stream 20 is from an energized subterranean region, the pressure of the energized subterranean region providing the lift for energized stream 20 to reach the surface. In an alternate embodiment, energized stream 20 is downstream of a device to increase pressure. Referring to FIG. 8B and described with reference to FIG. 8A, bypass line 24 provides control of the flow rate of energized stream 20 entering turbine 108, using valve 700. Valve 700, controlled at the surface, can divert a part of energized stream 20 through bypass line 24 to turbine discharge stream 14, which can adjust the flow rate of energized stream 20 to turbine 108. The flow rate of energized stream 20 directs the speed (rotations per minute or RPMs) of turbine 108, where the velocity of energized stream translates to the RPMs of turbine 108. Turbine 108 produces harvested energy 12 which drives pressure boosting device 106 as described with reference to FIG. 1.

Pressure boosting device 106 increases the pressure of depressurized stream 22 to produce pressurized fluid stream 10. Depressurized stream 22 is any stream that does not have sufficient pressure to reach the surface from the wellbore. In at least one embodiment, depressurized stream 22 is from a depressurized subterranean region, the zonal pressure of the depressurized subterranean region being less than the energized subterranean region.

In certain embodiments, energized stream 20 is produced by a strong well and can be used to drive turbine 108, which drives pressure boosting device 106 to increase the pressure of depressurized stream 22 which is produced by a weak well. In embodiments where the fluid management system is used to produce fluids from separate wells, for example where a fluid from a strong well is used to produce a fluid from a weak well, the fluid management system will be located on a surface.

Fluid management system 100 can include one or more packers installed in the wellbore. The packer can be used to separate fluids in the wellbore, isolate fluids in the wellbore, or redirect fluids to the different devices in the system. FIGS. 4 through 5 illustrate embodiments of fluid management system 100 that contain packers, packers 430.

In at least one embodiment, fluid management system 100 can be located at a surface to recover multiphase fluid 2. Examples of surfaces includes dry land, the sea floor, and the sea surface (on a platform). When fluid management system 100 is located at a surface, fluid management system 100 is in the absence of a packer. A fluid management system located a surface can be used to boost the pressure of fluids in the same well or from neighboring (adjacent) wells. A fluid management system located downhole can be used to boost the pressure of fluids in the same well.

In at least one embodiment, fluid management system 100 is in the absence of a jet pump. The combination of turbine and compressor in fluid management system 100 has a higher efficiency that a jet pump.

In at least one embodiment, fluid management system 100 is in the absence of reinjecting into the wellbore or reservoir any portion of turbine discharge stream 14, pressurized fluid 10, or commingled production stream 16.

Although embodiments of the present invention have been described in detail, it should be understood that various changes, substitutions, and alterations can be made without departing from the principle and scope of the invention. Accordingly, the scope of the present invention should be determined by the following claims and their appropriate legal equivalents.

The singular forms "a," "an," and "the" include plural referents, unless the context clearly dictates otherwise.

"Optional" or "optionally" means that the subsequently described event or circumstances can or may not occur. The description includes instances where the event or circumstance occurs and instances where it does not occur.

Ranges may be expressed as from about one particular value to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used throughout and in the appended claims, the words "comprise," "has," and "include" and all grammatical variations thereof are each intended to have an open, non-limiting meaning that does not exclude additional elements or steps.

As used throughout, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present invention.

What is claimed is:

1. A fluid management system positioned in a wellbore for recovering a multiphase fluid having a carrier fluid component and an entrained fluid component from the wellbore, the fluid management system comprising:

inlet tubing, the inlet tubing configured to receive the multiphase fluid, where the inlet tubing selected from the group consisting of tubing, piping, hose, or combination of the same;

a downhole separator fluidly connected to the inlet tubing, the downhole separator configured to produce a carrier fluid and a separated fluid from the multiphase fluid, the carrier fluid having a concentration of the entrained fluid component, the carrier fluid having a carrier fluid pressure, the separated fluid having a separated fluid pressure;

carrier tubing fluidly connected to the downhole separator, the carrier tubing configured to convey the carrier fluid from the downhole separator to an artificial lift device, where the carrier tubing is selected from the group consisting of tubing, piping, hose, or combination of the same;

the artificial lift device fluidly connected to the carrier tubing, the artificial lift device configured to increase the carrier fluid pressure to produce a turbine feed stream, the turbine feed stream having a turbine feed pressure;

turbine tubing fluidly connected to the artificial lift device, the turbine tubing configured to convey the turbine feed stream from the artificial lift device to the turbine, where the turbine tubing is selected from the group consisting of tubing, piping, hose, or combination of the same;

the turbine fluidly connected to the turbine tubing, the turbine configured to convert fluid energy in the turbine feed stream to harvested energy, wherein conversion in the turbine of fluid energy from the turbine feed stream to harvested energy produces a turbine discharge stream, the turbine discharge stream having a turbine discharge pressure, wherein the turbine discharge pressure is less than the turbine feed pressure; and a coupling physically connected to the turbine, the coupling configured to transfer the harvested energy from the turbine to a pressure boosting device, the coupling selected from a mechanical coupling, hydraulic coupling, and magnetic coupling;

fluid tubing fluidly connected to the downhole separator, the fluid tubing configured to convey the separated fluid from the downhole separator to a pressure boosting device, where the fluid tubing is selected from the group consisting of tubing, piping, hose, or combination of the same;

the pressure boosting device, the pressure boosting device fluidly connected to the fluid tubing and physically connected to the turbine, the pressure boosting device configured to convert the harvested energy to pressurized fluid energy, wherein conversion of harvested energy to pressurized fluid energy produces a pressurized fluid stream having a pressurized fluid pressure, wherein the pressurized fluid pressure is greater than the separated fluid pressure;

surface tubing fluidly connected to the pressure boosting device, the surface tubing configured to convey the pressurized fluid stream to the surface, the surface tubing is selected from the group consisting of tubing, piping, hose, or combinations of the same; and discharge tubing fluidly connected to the turbine, the discharge tubing configured to convey the turbine discharge stream to the surface.

2. The fluid management system of claim 1 further comprising:

a mixer, the mixer fluidly connected to both the artificial lift device and the pressure boosting device, the mixer configured to commingle the turbine discharge stream and the pressurized fluid stream to produce a commingled production stream, the commingled production stream having a production pressure.

3. The fluid management system of claim 1, wherein the artificial lift device is an electric submersible pump and the pressure boosting device is a compressor.

4. The fluid management system of claim 1, wherein the artificial lift device is a downhole gas compressor and the pressure boosting device is a submersible pump.

5. The fluid management system of claim 1, wherein a speed of the turbine is controlled by adjusting a flow rate of the turbine feed stream through the turbine.

6. The fluid management system of claim 1, wherein the concentration of the entrained fluid component in the carrier fluid is between 1% by volume and 10% by volume.

7. The fluid management system of claim 1, wherein the multiphase fluid is from the group consisting of oil entrained with gas, water entrained with gas, gas entrained with oil, gas entrained with water, and combinations thereof.

8. The fluid management system of claim 1 further comprises a production casing such that the separator, the artificial lift device, the pressure boosting device, and the turbine are contained in the production casing.

9. The fluid management system of claim 1 further comprises a production tube and a secondary tube arranged in parallel in the wellbore, wherein the artificial lift device and the turbine are contained in the production tube and the pressure boosting device is contained in the secondary tube, where each of the production tube and the secondary tube are fluidly connected to the downhole separator, where the coupling extends through the wall of each of the production tube and the secondary tube to connect the turbine and the pressure boosting device.

10. The fluid management system of claim 1 further comprises a production casing and an inner tubing such that the inner tubing is positioned in the production casing, wherein the pressure boosting device is positioned in the inner tubing, wherein the artificial lift device and the turbine are positioned in the production casing, wherein the coupling extends through the wall of the inner tubing to connect the turbine and the pressure boosting device.

11. The fluid management system of claim 1 further comprises a production casing and an inner tubing such that the inner tubing is positioned in the production casing, wherein the pressure boosting device is positioned in the production casing, wherein the artificial lift device and the turbine are positioned in the inner tubing, wherein the coupling extends through the wall of the inner tubing to connect the turbine and the pressure boosting device.

* * * * *